US007470045B2

(12) United States Patent
Bansbach et al.

(10) Patent No.: US 7,470,045 B2
(45) Date of Patent: Dec. 30, 2008

(54) ASSEMBLY FOR DIRECTED SHADING OF OUTSIDE LIGHTING

(75) Inventors: Udo Bansbach, Berlin (DE); Dieter Albert, Berlin (DE)

(73) Assignee: Semperlux AG, Berlin (DE)

( * ) Notice: Subject to any disclaimer, the term of this patent is extended or adjusted under 35 U.S.C. 154(b) by 0 days.

(21) Appl. No.: 11/528,184

(22) Filed: Sep. 26, 2006

(65) Prior Publication Data

US 2007/0070632 A1 Mar. 29, 2007

(30) Foreign Application Priority Data

Sep. 28, 2005 (DE) ..... 10 2005 047 746

(51) Int. Cl.
*F21V 5/00* (2006.01)

(52) U.S. Cl. ..... 362/327; 362/308; 362/332; 362/336; 362/339

(58) Field of Classification Search ..... 362/308, 362/327, 332, 336, 339
See application file for complete search history.

(56) References Cited

U.S. PATENT DOCUMENTS

| | | | | |
|---|---|---|---|---|
| 3,371,201 A | | 2/1968 | Yonkers | |
| 3,593,014 A | * | 7/1971 | Vesely | 362/291 |
| 3,646,338 A | | 2/1972 | Goytisolo | |
| 4,215,390 A | * | 7/1980 | Brandt | 362/311 |
| 4,263,641 A | | 4/1981 | Ferrero | |
| 4,669,034 A | | 5/1987 | Bansbach et al. | |
| 6,099,148 A | * | 8/2000 | Northrup et al. | 362/336 |
| 7,168,839 B2 | * | 1/2007 | Chinniah et al. | 362/555 |

FOREIGN PATENT DOCUMENTS

| | | |
|---|---|---|
| CH | 186375 | 9/1936 |
| DE | 1 027 151 | 9/1958 |
| DE | 2819539 | 11/1978 |
| EP | 0191264 | 8/1986 |
| GB | 217539 | 7/1924 |
| GB | 636982 | 5/1950 |
| GB | 1122968 | 8/1968 |

* cited by examiner

*Primary Examiner*—Sandra O'Shea
*Assistant Examiner*—James W Cranson
(74) *Attorney, Agent, or Firm*—Thorpe North & Western LLP

(57) ABSTRACT

A device for shielding outside lights comprising an essentially cylindrical, transparent shield body with a surface which is provided with a zigzag-shaped profile in a vertical direction in order to deflect the radiation from a lighting source incident on the shield body in a desired direction. Triangular projections of the zigzag-shaped profile in a first portion are designed and configured in such a way that the radiation from the lighting source is fully reflected in a desired direction when passing through the first portion of the shield body and triangular projections of the zigzag-shaped profile in a second portion are designed and configured in such a way that the radiation from the lighting source is diffracted in the desired direction when passing through the second portion of the shield body.

19 Claims, 21 Drawing Sheets

ASSEMBLY FOR DIRECTED SHADING OF OUTSIDE LIGHTING

TECHNICAL FIELD

The invention relates to a device for shielding outside lights comprising an essentially cylindrical, transparent shield body with a surface which is provided with a zigzag-shaped profile in a vertical direction in order to deflect the radiation from a lighting means incident on the shield body in a desired direction.

Such devices are used especially for lights with a high luminance. They prevent the direct sight into the lighting means. This is particularly important in outside areas where blinding of car drivers or passers-by must be prevented and directed light for an improved lighting of the traffic paths is needed.

PRIOR ART

EP 0 191 264 discloses an assembly for shielding outside lights with lighting means emitting light on large surfaces, where a plurality of identical rings with right angle triangular cross sections are stacked up on top of each other. The rings are provided with bore holes to receive threaded rods for the interconnection of the rings. The assemblies are usually made of plastics materials. The outer profile of the assembled assembly is flat and cylindrically and the inner profile is zigzag-shaped in an axial direction. Each ring of the inner profile is provided with a surface in a radial direction and with a surface inclined by 40° thereto. The cylindrical shield body designed in such way is arranged around the lighting means. The radiation of the lighting means is then diffracted like in a prism and deflected downwardly in an axial direction to a large extend. A further portion of the radiation is upwardly deflected.

A portion of the radiation of the lighting means is upwardly emitted in such an assembly. Thereby the so called "light smoke" is generated disturbing people living nearby and disturbing trees, houses and the like by extensive illumination.

SUMMARY OF THE INVENTION

It is an object of the invention to provide a device of the above mentioned kind with an improved emission profile.

According to the present invention this object is achieved in that in a first portion the triangular projections of the zigzag-shaped profile are designed in such a way that the radiation from the lighting means is fully reflected in a desired direction when passing the shield body and in a second portion the triangular projections of the zigzag-shaped profile are designed in such a way that the radiation of the lighting means is diffracted in the desired direction when passing the shield body.

Due to the combination of total reflection and diffraction the amount of radiation which is upwardly emitted can be reduced. Radiation which cannot be downwardly deflected by diffraction can be deflected otherwise in such assembly in the desired downward direction. No separate mirrors or the like are necessary. By adapting the tip angles of the triangular projections the emission features can be further optimized. As more radiation is downwardly emitted, lights with less power may be used and/or an improved lighting result is achieved. Disturbances due to light smoke are avoided.

In one embodiment, the shield body is formed by one single, integral body. No additional connecting means, such as threaded bolts or the like need be used. This makes it possible to make the shield body of glass, because the problem of breaking glass during connection procedure is reduced.

The radiation emitted by the lighting means always partly consists of UV-light. The color of glass does not fade when it is exposed to such UV-light as is the case with plastic material. Furthermore, glass is thermally more resistant than plastic material.

Preferably the zigzag-shaped profile is provided on the outside of the shield body. The shield body may be manufactured by pressing a plunger into the liquid material and taking it off after hardening. With such a mould the zigzag-shaped outer profile can be manufactured reproducibly and with high accuracy. Preferably the inside of the shield body has a conical shape. Half of the opening angle can be in the range of 0.5° to 3°, preferably about 2°. Thereby removing of the plunger during the manufacturing is facilitated.

In a particularly preferred embodiment of the invention, cylindric lenses are provided on the inside of the shield body, the cylindric lenses having an axis of curvature extending in an axial direction. Such cylindric lenses are particularly suitable when lighting means with small emitters are used, as is the case with high pressure lights with clear glass bulbs. Even for an assembly according to the present invention, there are angles where one can directly see into the lighting means. In order to avoid the blinding at these angles, diffusion in a circumferential direction is achieved by using a plurality of cylindric lenses. They extend along the entire height of the shield assembly. They form a sort of collar projecting towards the inside. Thereby not only one single image of the lighting means is produced but a multiple image. The luminance is distributed on a plurality of points thereby reducing the blinding.

In an alternative embodiment of the invention, the zigzag-shaped profile is provided on the inside of the shield body. The shield body may be made of plastic material, such as polycarbonate. The production can be effected by pressing a light transparent plastic material into a plane mould with a zigzag-shaped surface and bending of the product made in such way, in order to form one segment of the shield body. Two or more segments are put together afterwards to form the complete shield body. With such a manufacturing method, the zigzag-shaped profile can be on the inside because it is not necessary anymore to remove a plunger. When plastic material is used, a light transparent heat shield is preferably provided in the inner volume of the shield body. Such a heat shield can be a cylindric glass body coaxially disposed within the shield body. Thereby heat from the lighting means is essentially kept away from the plastic body. In a further embodiment of the invention, cylindric lenses are integrally provided inside on the heat shield, the cylindric lenses having an axis of curvature extending in an axial direction. These cylindric lenses have the same function as described above. They prevent blinding if one directly looks into the lighting means.

Additionally, in a further embodiment of the invention, an auxiliary shield can be provided outside the shield body for shielding selected angular regions in a circumferential direction. The auxiliary shield may comprise prisms having a prism ridge extending in an axial direction and being positioned side-by-side in a circumferential direction. Very often it is the case that, for example, a street light shall illuminate the foot path and the street, however it shall not illuminate the houses positioned behind the light or on the opposite side. The angular region in these directions should be completely shielded, if possible. The radiation emitted in these directions can be deflected in a desired direction by means of an auxiliary shield.

Different auxiliary shields can be provided for shield bodies with different diameters. The shield body can be curved with a center point of curvature coincident with the center of the lighting means.

Embodiments of the invention are described below in greater detail with reference to the accompanying drawings. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

BRIEF DESCRIPTION OF THE DRAWINGS

In the accompanying drawings, which show the best modes presently contemplated for carrying out the invention.

DETAILED DESCRIPTION OF THE ILLUSTRATED EMBODIMENTS

Figure 1:
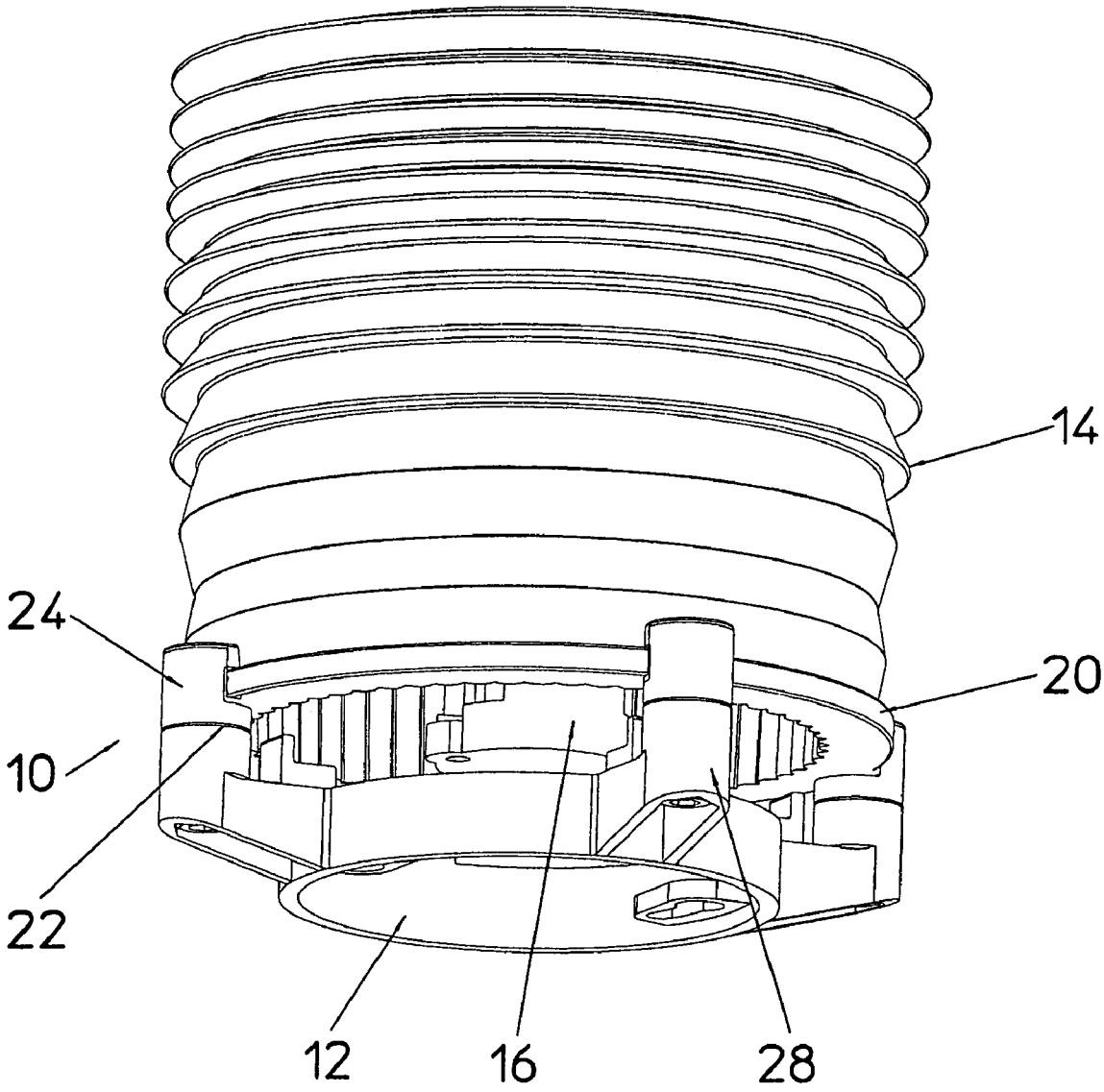
FIG. 1 is a perspective view of an assembly for shielding of outside lights, where the shield body has an outside profile.
Figure 2:
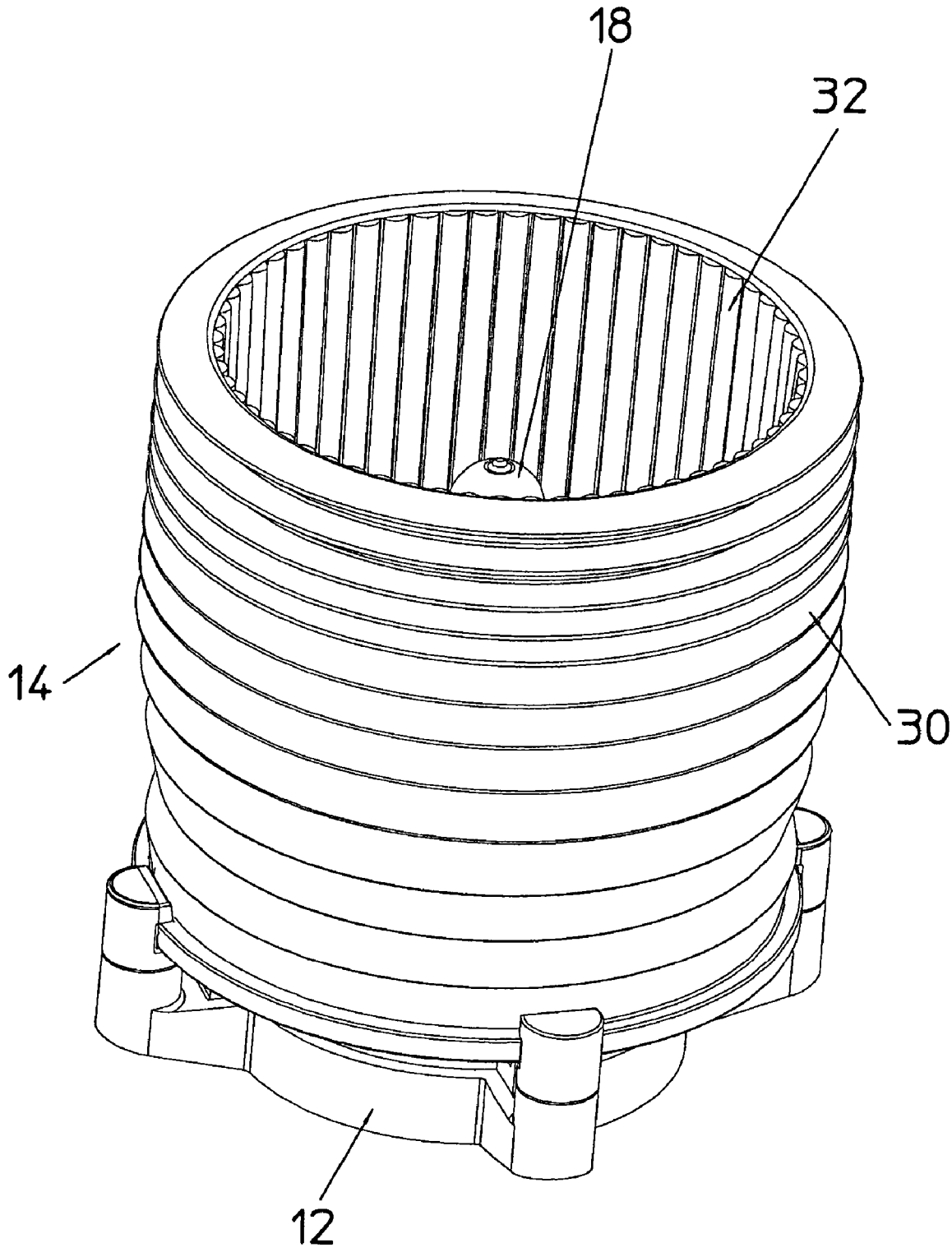
FIG. 2 shows the assembly of FIG. 1 from a view from the upside, where the profile on the inside of the shield body is visible.

In FIG. 1 a portion of an outside light generally denoted by numeral 10 is shown. The outside light 10 comprises a carrier 12, a shield body 14 and a socket 16 for a lighting means. A portion of the lighting means 18 can be seen in the view of FIG. 2. The shield body 14 is provided with a lower rim 20. This rim 20 is held in a groove 22 in connecting means 24. The connecting means are inserted in receptacles 28 of carrier 12, provided for this purpose. In the present embodiment the shield body 14 is held in four of such connecting means, which are evenly distributed along the circumference. The carrier is cast iron and it is connected within the outside light.

The shield body 14 is essentially cylindrical and rotation symmetric. The shield body 14 is provided with a profile both on the outside 30 and on the inside 32. Depending on the size, twenty to eighty cylinder lenses are integrated side-by-side on the inside 32. Sixty cylinder lenses are provided for a shield body with a smaller radius of, for example, 65 mm. The radius of the curvature of the cylinder lenses is 2.9 mm. The cylinder lenses extend over the entire length of the shield body 14.

Figure 3A:
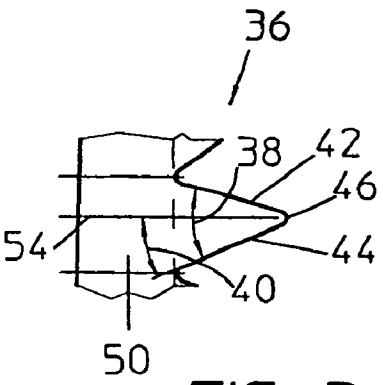
FIG. 3*a* is an enlargement of a portion of the shield body cross section of FIG. 3.
Figure 3:
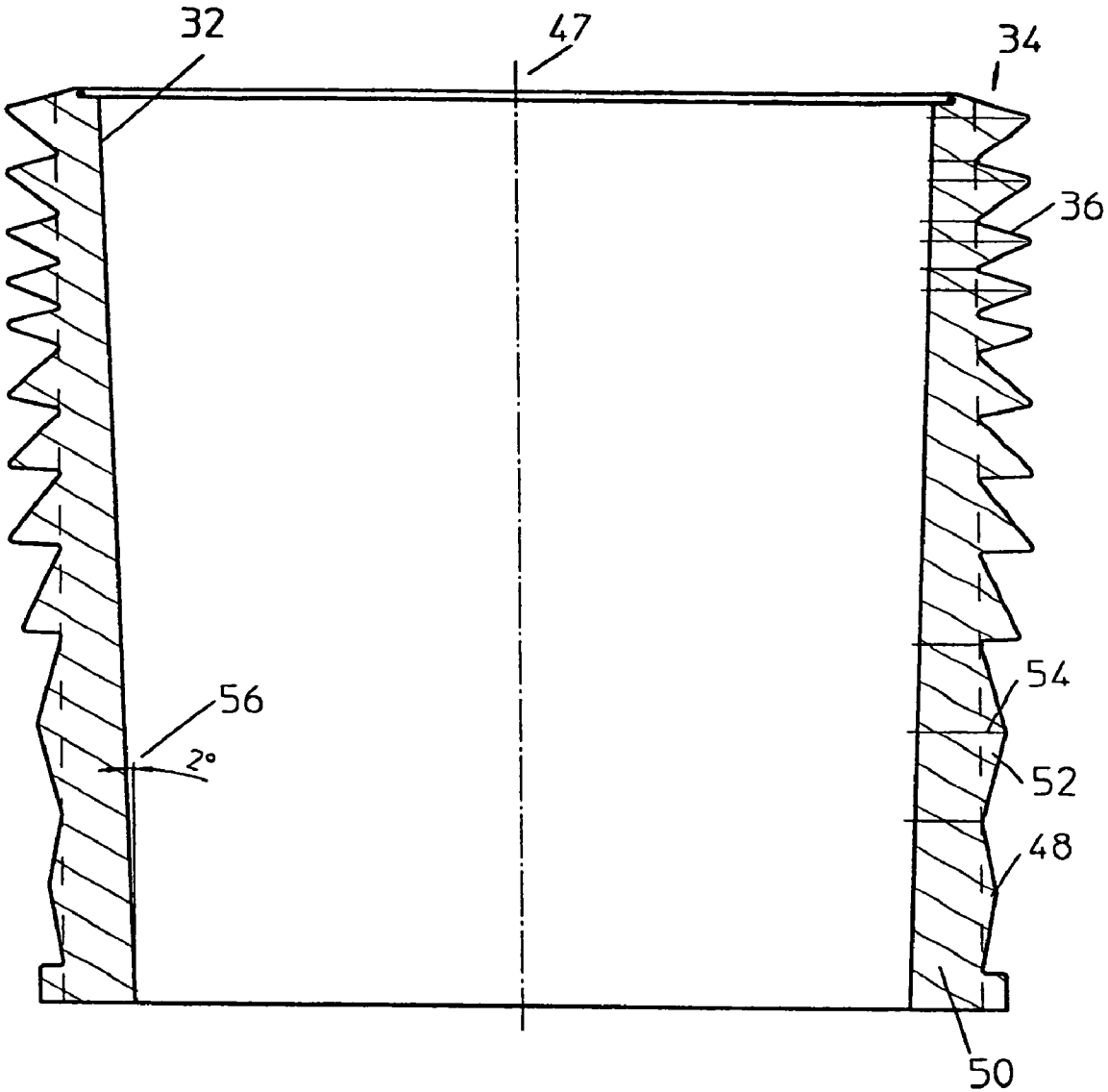
FIG. 3 is a vertical cross section of the shield body of FIGS. 1 and 2.

The profile on the outside of the shield body is described with reference to FIG. 3 and FIG. 3*a*. In these cross sectional views it can be seen that the outer profile has a zigzag-shaped outline 34 with triangular projections 36 extending towards the outside. The projections 36 are different from each other. They have different tip angles 38 and the limiting surfaces 42 and 44 have different inclination angles with respect to the horizontal line, shown in FIG. 3*a* as horizontal line 54. In certain areas the tips 46 project towards the outside to a different extent, i.e., they have a different distance to the symmetry axis 47 of the shield body 14. All projections 36 are an integral part of a basic cylinder 50, that a minimum width of the shield body is provided between the projections. The inside 32 of the shield body is conically shaped with an opening angle of 2° with respect to the vertical line 56.

Eleven projections have been chosen for the present embodiment. With such an amount, the assembly will not be too thick, similar to a Fresnel-lens. The lowest projections 48 and 52 are flat and have a large tip angle 38. The tip angle 38 of the projections which are further up decreases at first and then increases again. The inclinations at the upper limiting surface 42 of the projections with respect to the horizontal line 54 decreases towards the upside. The inclination of the lower limiting surface 44 of the projections with respect to the horizontal line 54 increases towards the upside. The tip angle 38 is not symmetrical with respect to the horizontal line 54. The lower angle 40, therefore, does not necessarily correspond to half of the tip angle 38.

The shield body 14 is made of glass with a refractive index in the range of about n=1.52. As the profile on the inside is constant in a vertical direction and changes only in a circumferential direction, the shield body can be pressed by means of a plunger. The plunger is pressed into the liquid glass material in a mould. After hardening the plunger can be upwardly removed. The shield body can be made in the form of one integral piece or of several segment portions.

Figure 4:
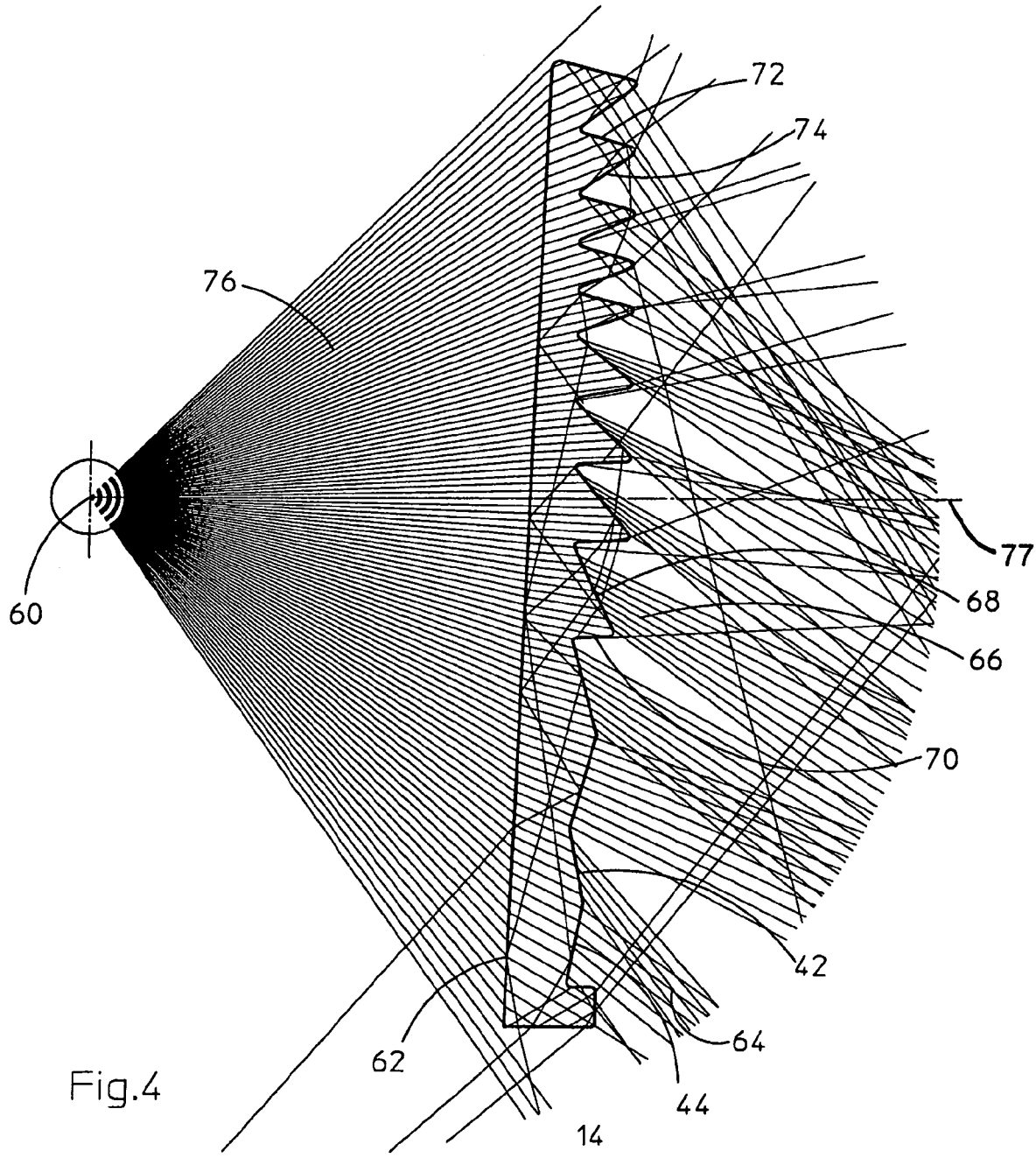
FIG. 4 shows the path of rays of a point light source in a shield body of FIG. 3.

With this embodiment of the shield body as described above a transmission characteristic is obtained which is illustrated in FIG. 4 for visible light. Radiation 76 which is evenly emitted from a point source of light 60 meets the inside 62 of the shield body 14. At the transition surface it is diffracted for the first time. In the area below the horizontal plane 77 through the point light source 60, the radiation is slightly upwardly deflected. In the area above the horizontal line, the radiation is slightly downwardly deflected. The radiation exits the shield body at both surfaces 42 and 44 of the two projections on the bottom. The radiation 64 is there downwardly deflected. The projection above are designed in such a way, that the radiation is diffracted and accordingly exits only at the upper surface 68 in a downward direction and not at the lower surface 70. The tip angles of the projections are, therefore, small and cause the entire radiation to be deflected in a downward direction. The upper most projections are again designed in such a way that the radiation meets the upper surface 72 with an angle causing total reflection. The radiation is totally reflected at the upper surface 72 and exits at the lower surface 74 of the projection where it is further diffracted. In such a way, even portions of the radiation 76 emitted by the light source in a very much upwards direction are downwardly deflected without further mirrors or other optical elements. The entire radiation of the light source is emitted with a relatively even distribution in a preferred downwardly directed angular range.

It can be seen that not only lighting means with large surfaces can be used as a light source, but also lighting means with very small burners and clear glass bulbs, such as high pressure lights, such as Halogen-metal vapor-lights and sodium-vapor lights with short burner technology. The assembly is, however, also suitable for fluorescent lights emitting on large surfaces. Due to the good heat resistance of the material, such lights may operate with a power of up to 200 W.

Figure 5:
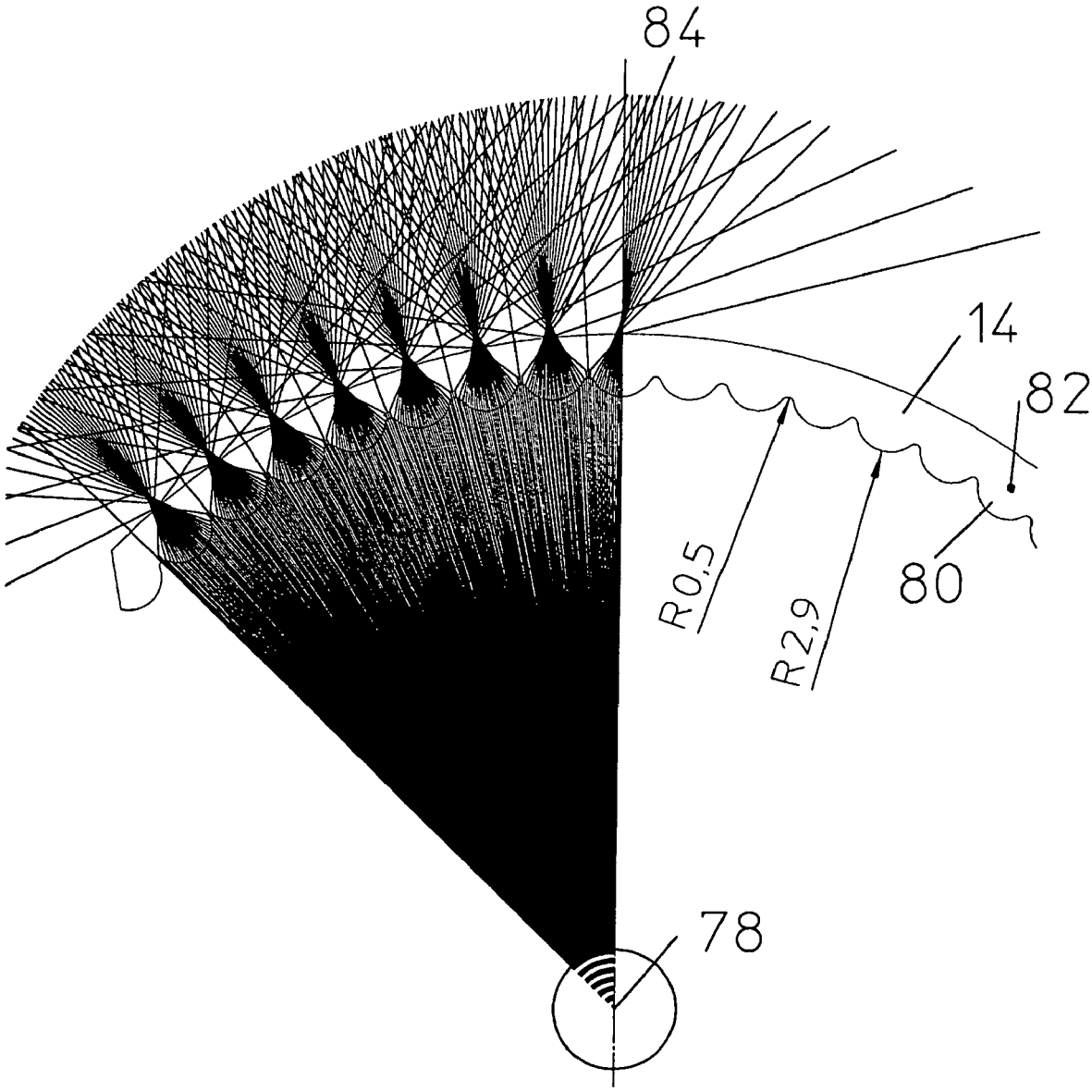
FIG. 5 illustrates the effect of the profiling on the inside of the shield body with cylindric lenses with vertical axis of curvature.

FIG. 5 illustrates the effect of cylindric lenses on the radiation of a point source of light 78. The top view of FIG. 5 shows a segment of the shield body 14. Cylindric lenses 80 form an integral part of the inside of the shield body 14. The cylindric lenses 80 have a radius of 2.9 mm. The axis of curvature 82 runs parallel to the symmetry axis of the shield body, which coincides with the position of the point source of light 78 in the present case. A plurality of cylindric lenses are disposed along the inner surface of the shield body 14. An oppositely curved connection portion with a radius of curvature of 0.5 mm is provided at the transitions between the cylindric lenses. The cylindric lenses act as collimating lenses and focus the radiation of the light source 78 in a plurality of lines 84 which run vertically also. Apart from this, the radiation remains evenly distributed along the circumference. The use of cylindric lenses provides the advantage that even if the viewer has a direct insight into the lighting means, if the viewer looks into the lighting means under a certain angle, the viewer will be illuminated by a portion of the radiation only. The radiation is distributed in a plurality of points. Thereby blinding is essentially reduced. The lighting means is optically broadened.

Figure 6:
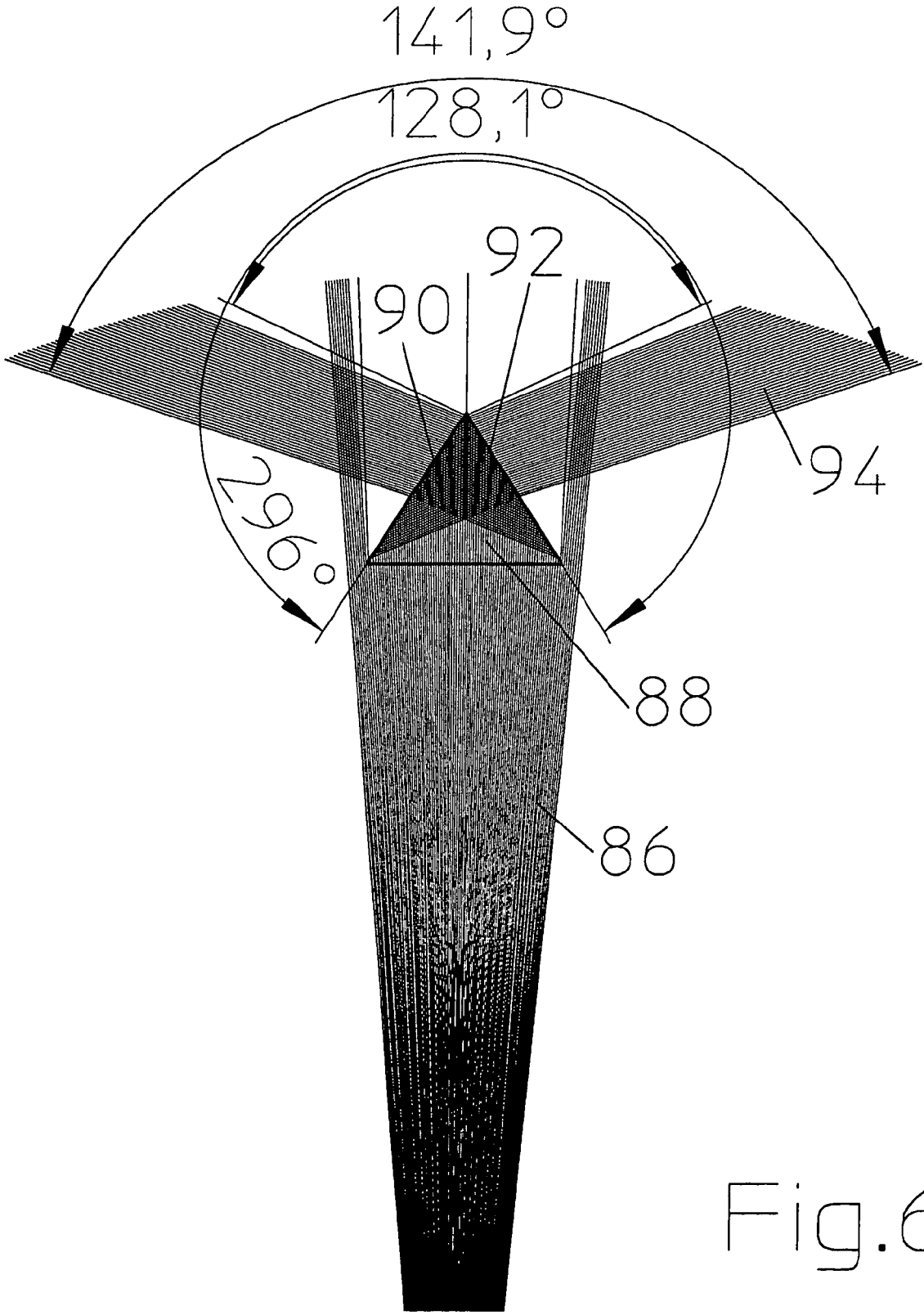
FIG. 6 illustrates the effect of a prism positioned as an auxiliary shield before the shield body.

FIG. 6 shows how the radiation 86 meeting a prism 88 from a small angular region is totally reflected on surfaces 90 and 92 and deflected in a sideways direction. This effect can be used to block radiation in certain directions and to deflect it in a desired direction.

Figure 7:
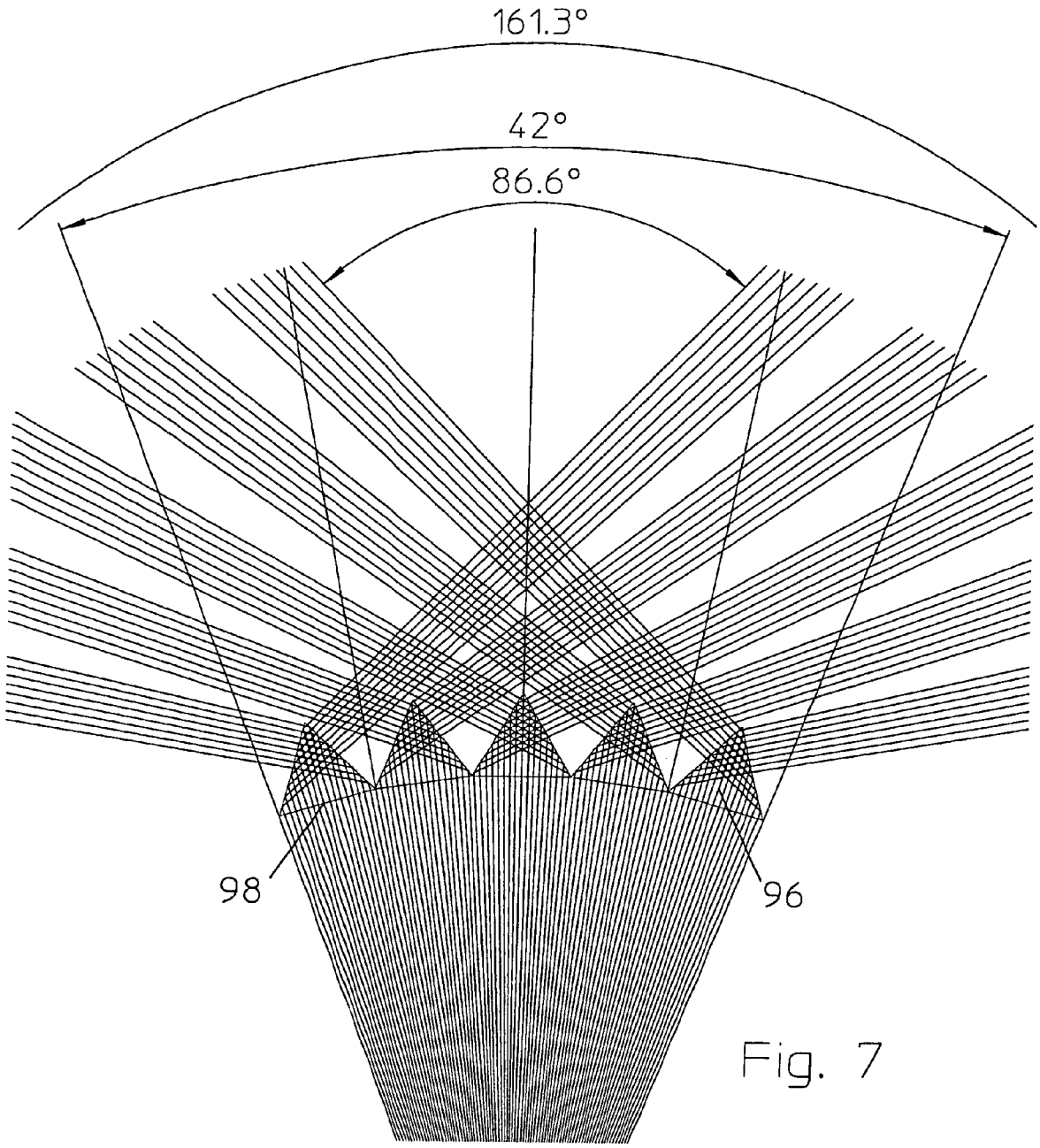
FIG. 7 illustrates the effect of several prisms positioned as auxiliary shields before the shield body.

FIG. 7 shows an auxiliary shield 96 which is constructed of five such prisms. The inner surfaces 98 of the prisms essentially run along an arc of a circle, the axis of curvature of which being coincident with the axis of curvature of the shield body (not shown). Radiation emitted in an undesired direction, for example on a house face along a street, can be deflected with the auxiliary shield 96. In the illustrated example, the average angular range of about 86.6° remains without radiation.

Figure 8:
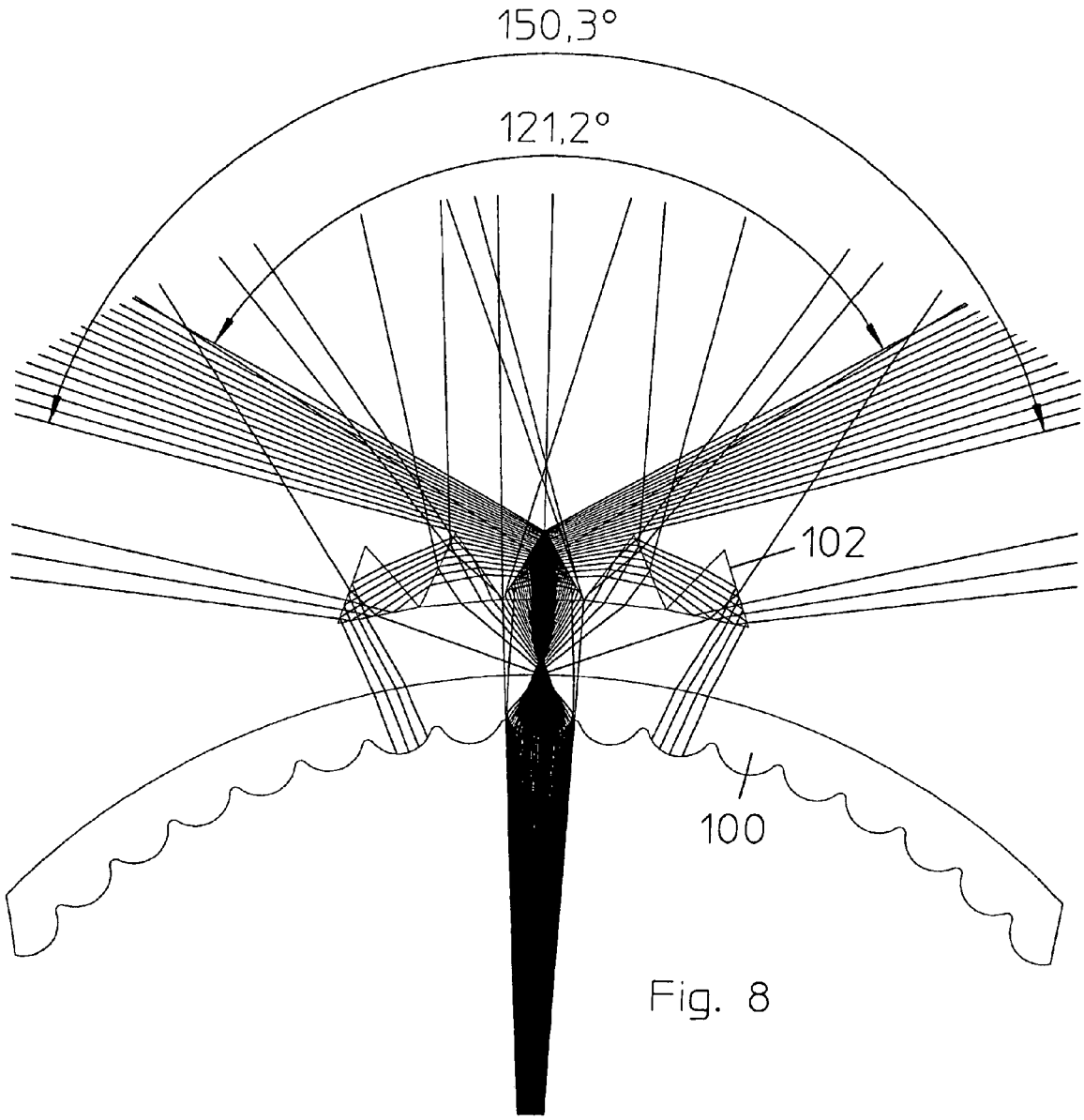
FIG. 8 shows the effect of the combination of a profiling on the inside of a shield body with cylindric lenses with vertical axis of curvature and an auxiliary shield with several prisms.
Figure 9:
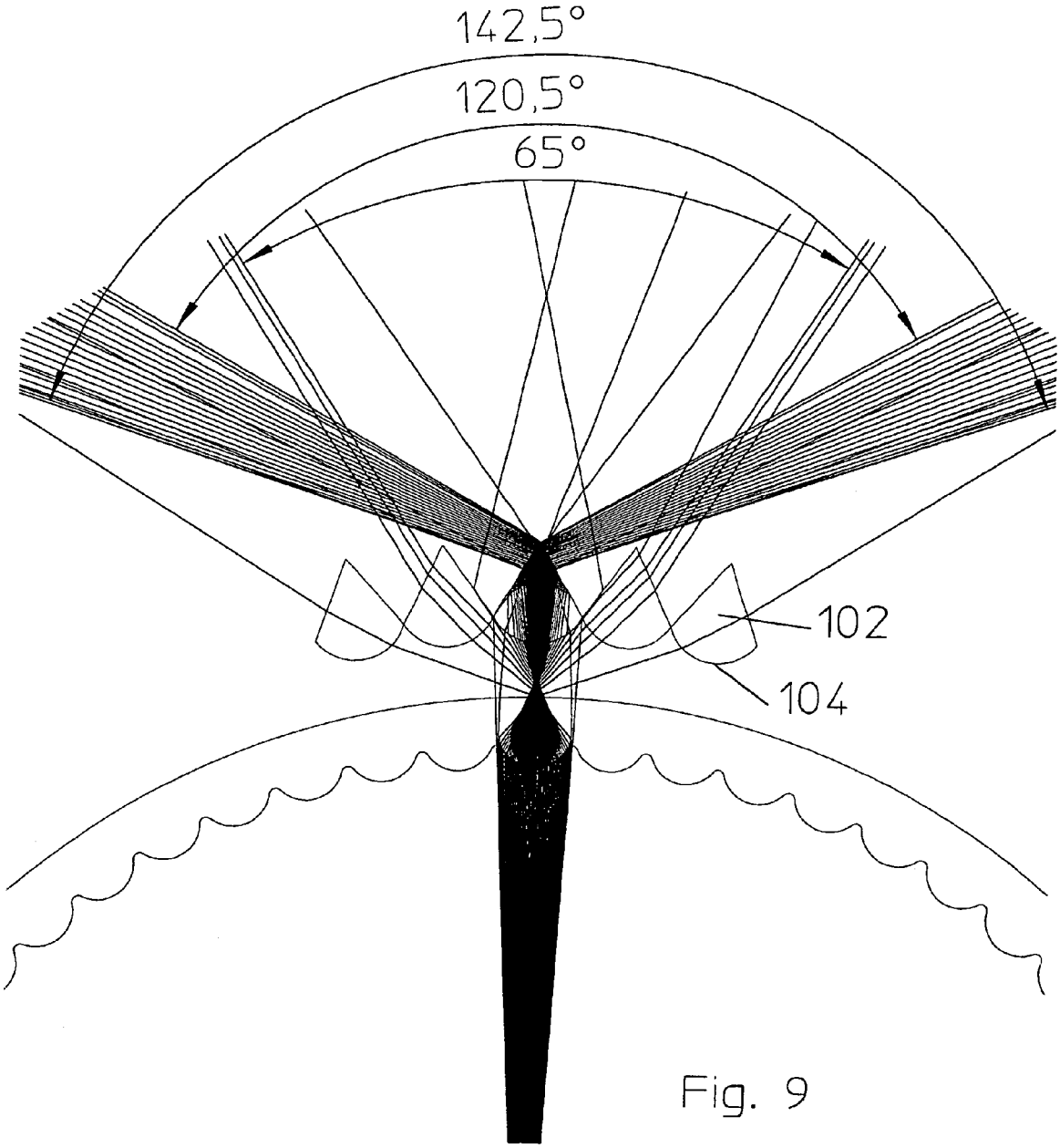
FIG. 9 shows a variation of the assembly of FIG. 8, where the inside of the auxiliary shield is provided with cylindric lenses which have a vertical axis of curvature.

FIG. 8 shows an assembly where shielding is effected by means of cylindric lenses 100 and an auxiliary shield 102 is provided. It can be seen that the individual effects of the cylindric lenses 100 and the auxiliary shield 102 essentially remain the same, even when they are combined. However, the cylindric lenses and the auxiliary shield can be combined, as shown, making use of the individual effects to produce desired overall effects. The auxiliary shield 102 can also be provided with cylindric lenses 104 as it is shown in FIG. 9.

Figure 10:
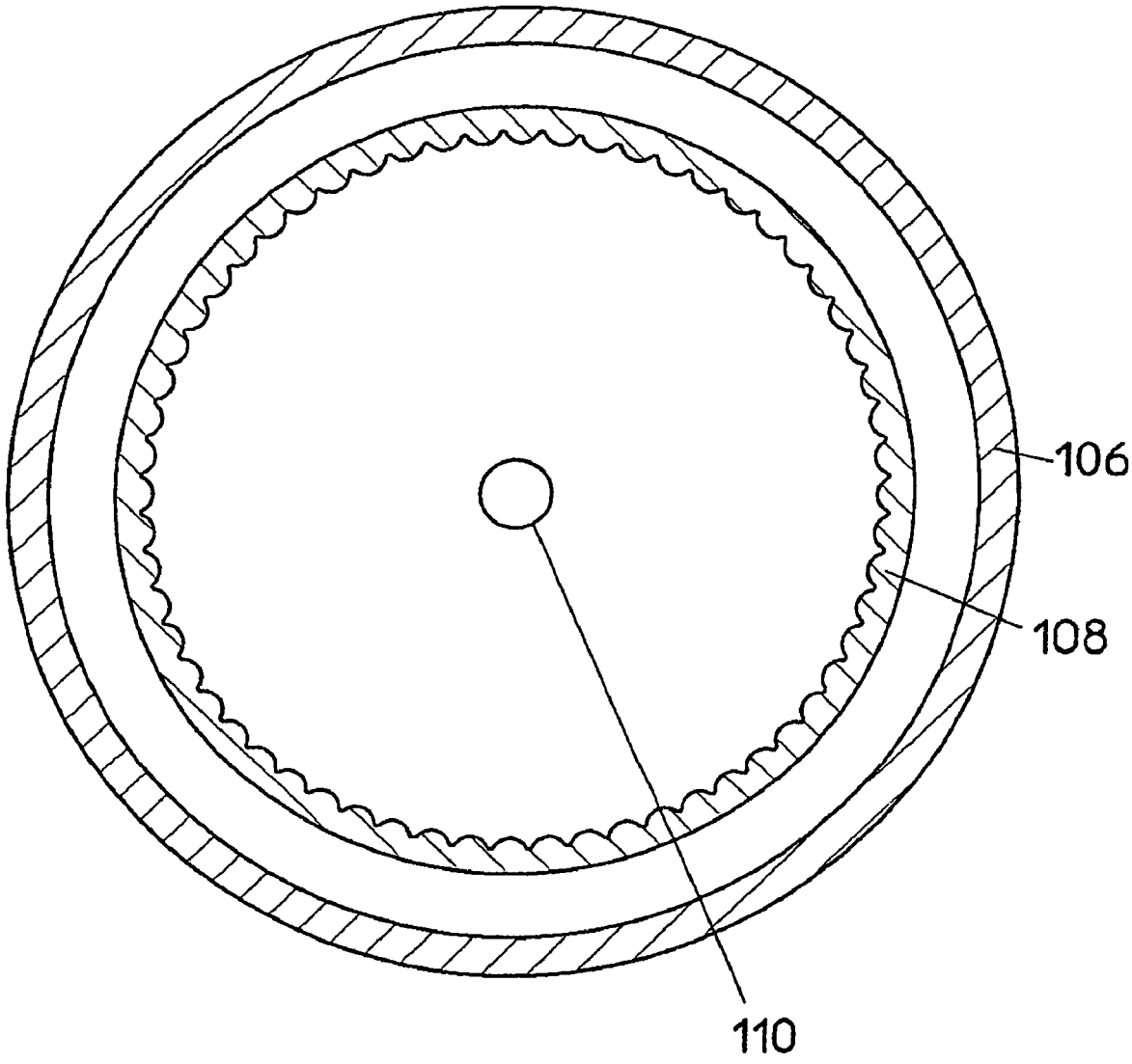
FIG. 10 is a horizontal cross section of a two-portion assembly with a plastic shield body.

The shield body according to another embodiment is made of plastic material instead of glass, for example RÖHM Hw55, which is a PMMA-mixture with Polycarbonate-portions and a temperature of use of up to about 105° C., a pure PMMA (Polymethylmethacrylat), such as ATOGLAS OROGLAS HT 121, or a pure Polycarbonate. Other plastic materials can also be used. A heat shield in the form of a glass cylinder 108 can be provided in this case between the plastic shield body 106 and the lighting means 110 (FIG. 10). In this two-portion embodiment, the cylindric lenses are an integral part of the glass body 108. The plastic shield body 106 is also provided with projections forming a zigzag-shaped profile. The radiation is also totally reflected and diffracted in a downwards direction. The profile, however, is disposed on the inside of the shield body. The outside is smooth. For producing such a shield body several segments are made which then are assembled. Each segment is pressed in one plane and bent afterwards.

The following illustrations show a device where the profile is provided on the inside of the shield body.

Figure 11:
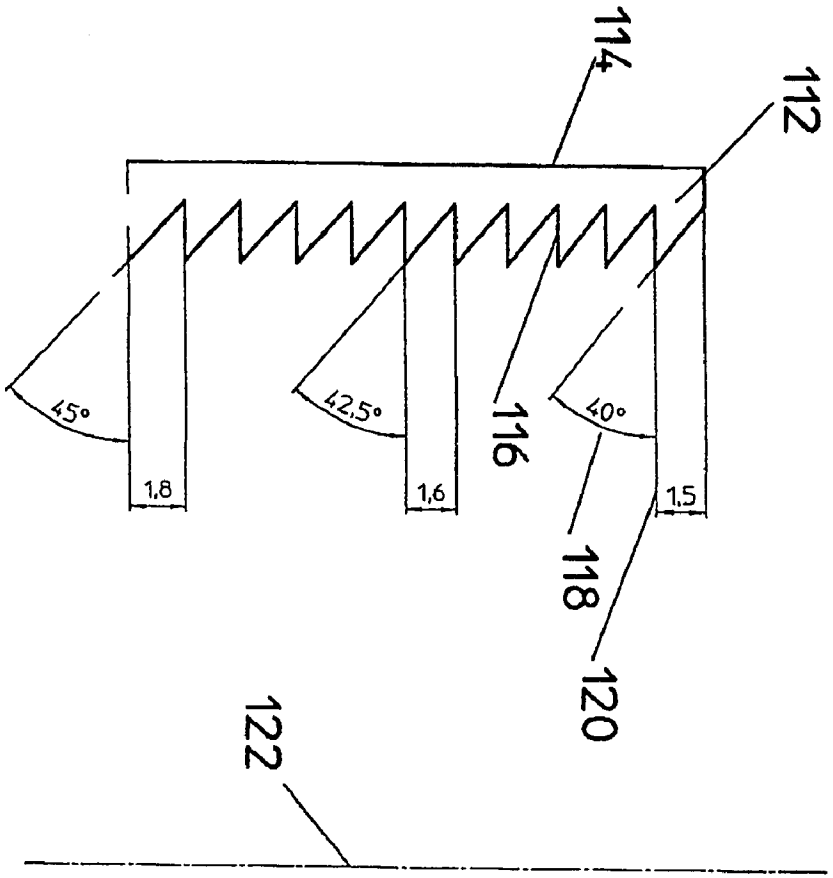
FIG. 11 is a vertical cross section of a shield body with a profile on the inside.

FIG. 11 shows a portion of a vertical cross section of a shield body 112. The outside 114 of the shield body is smooth. The inside 116 of the shield body has a prism-like profile. It can be seen that the angle 118 with respect to the horizontal line 120 increases in a downward direction. In such a way, the radiation is concentrated in a selected direction. The profile is directed with respect to the light axis 122.

Figure 12:
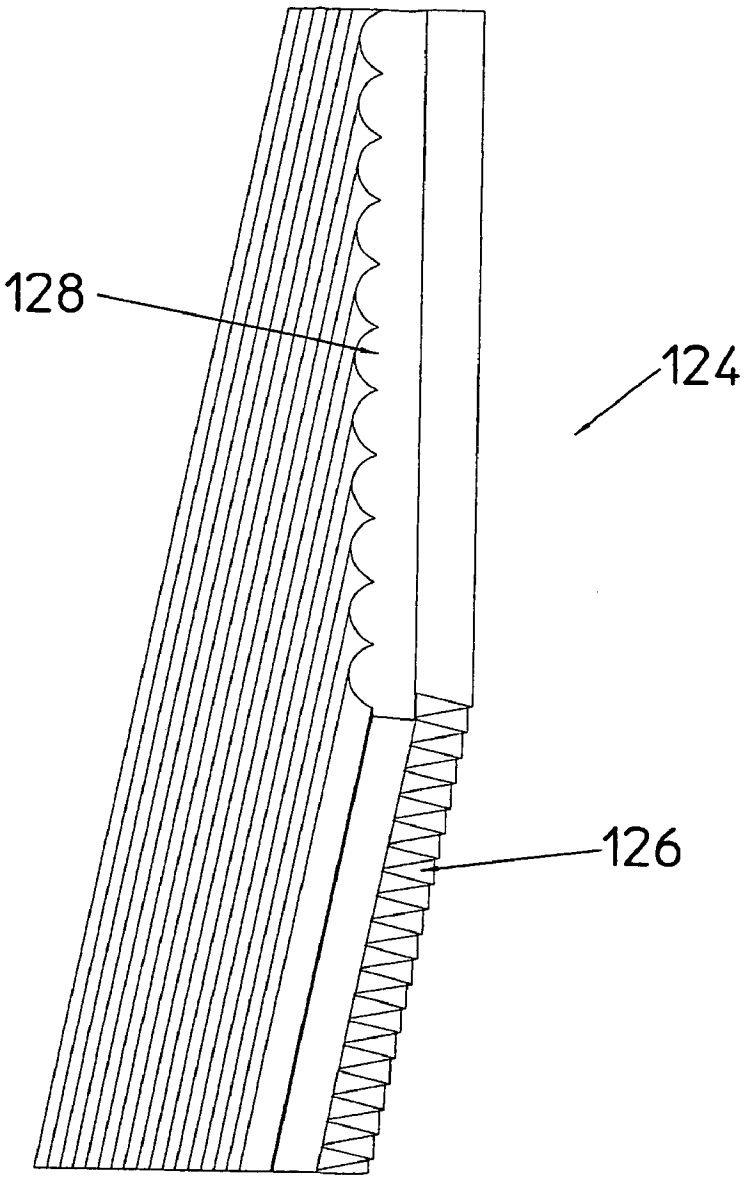
FIGS. 12 through 18 illustrate the manufacturing process for a shield body with a profile on the inside by means of bending.
Figure 13:
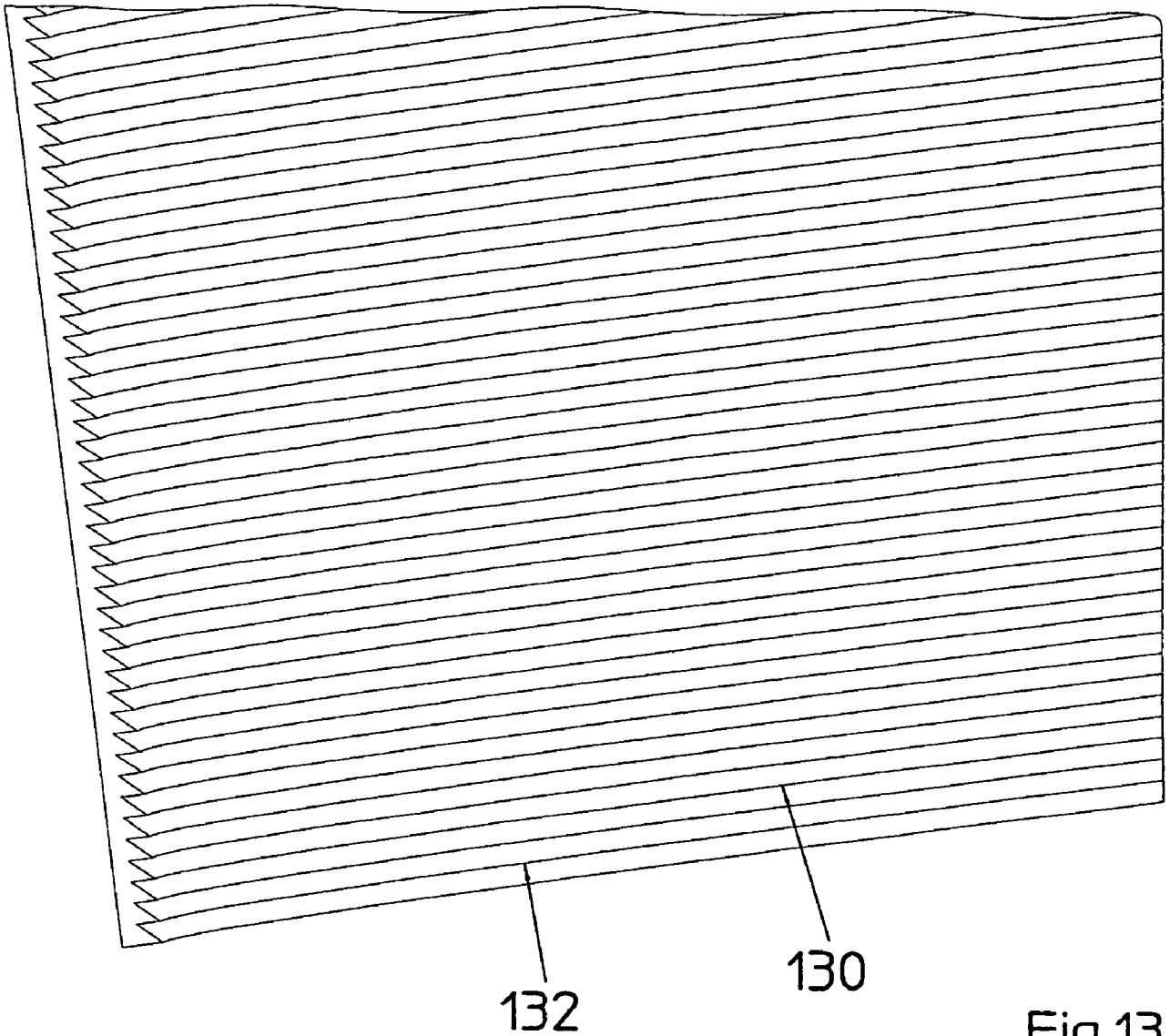
Figure 14:
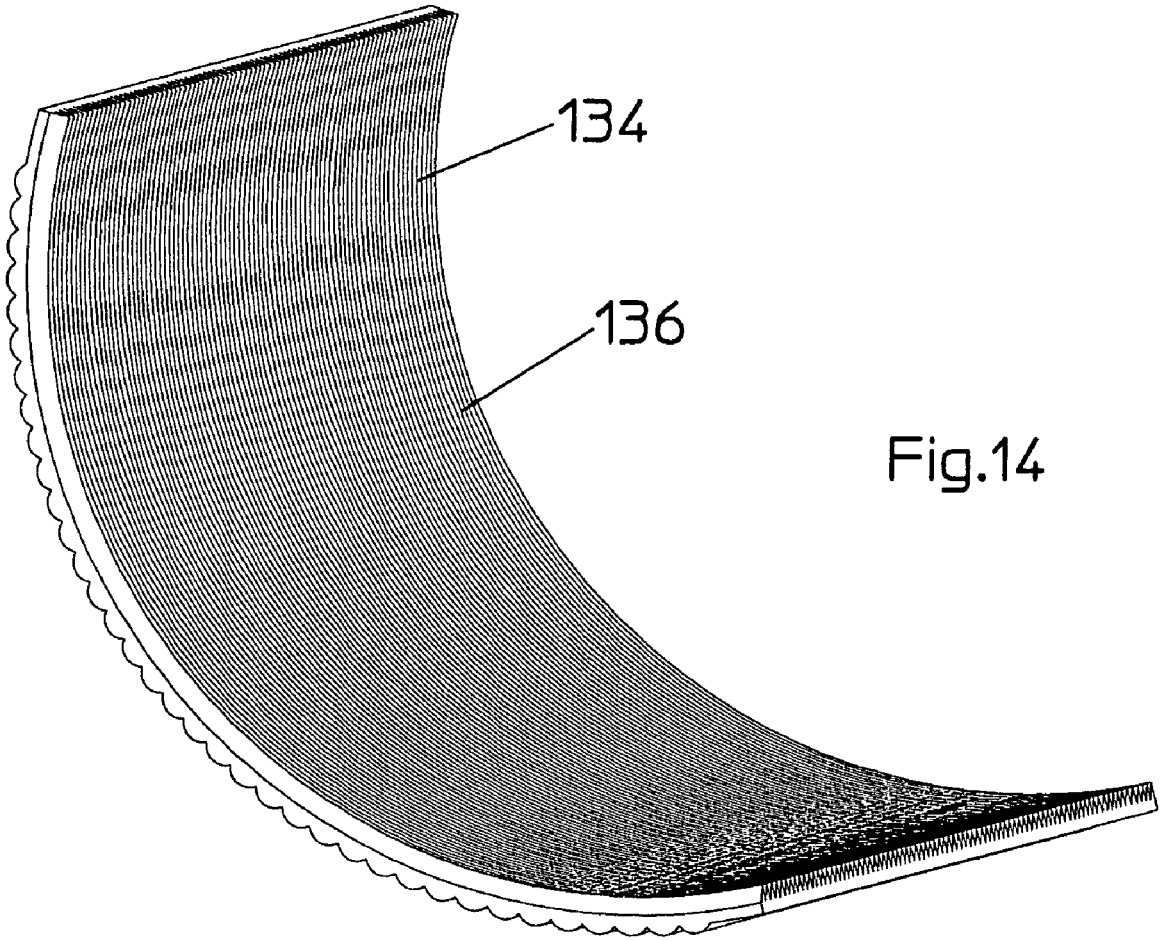
Figure 15:
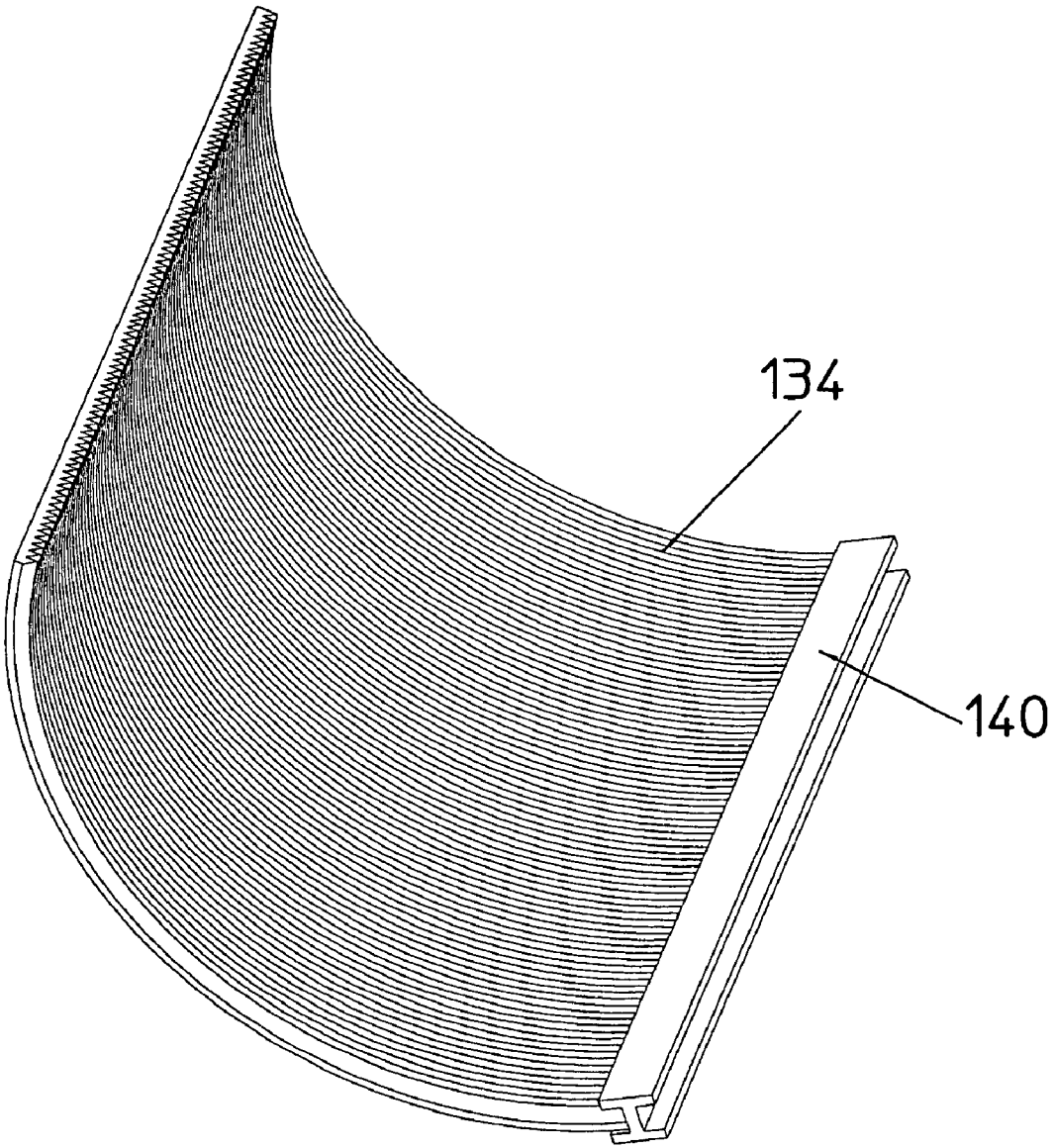
Figure 16:
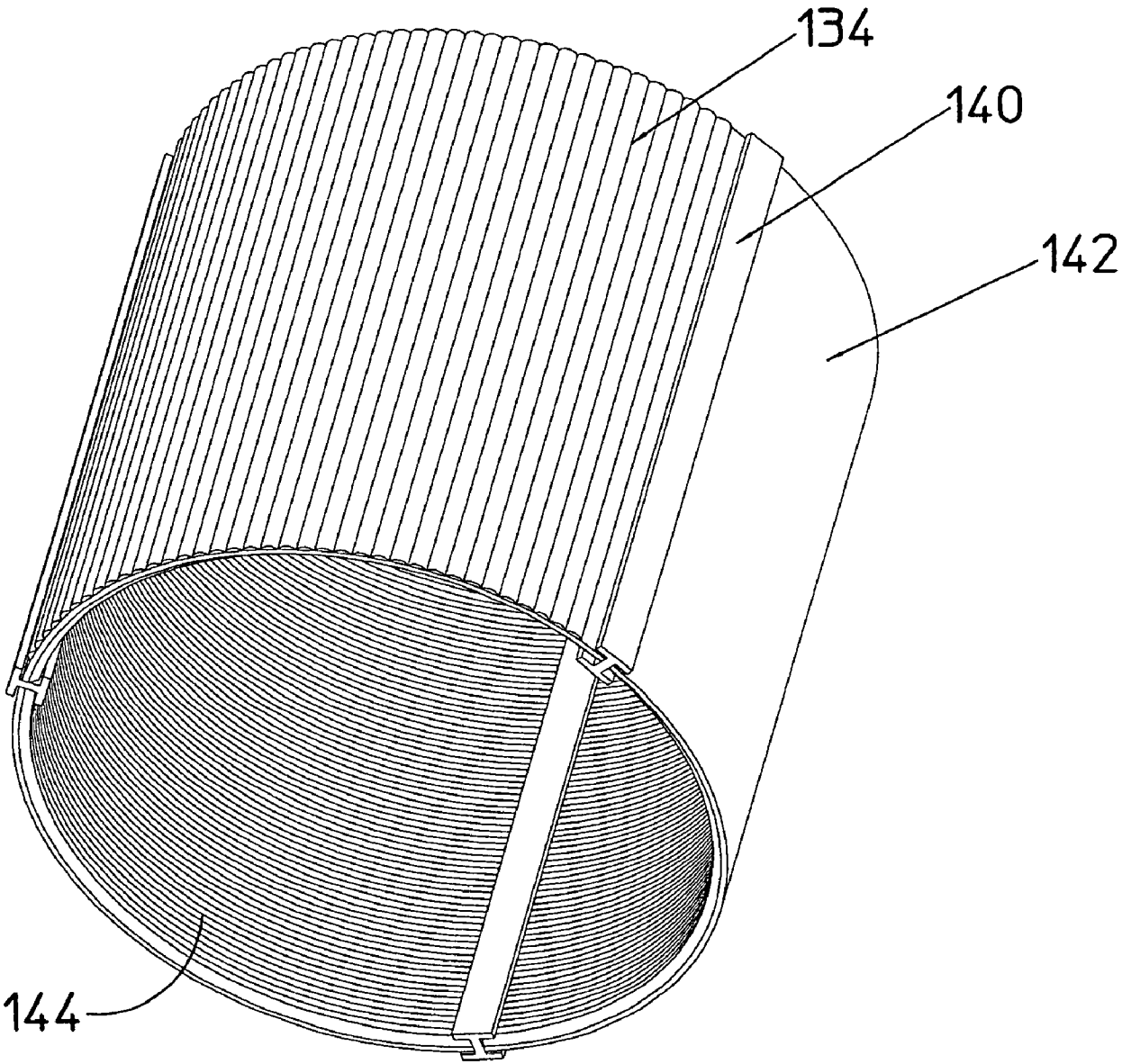
Figure 17:
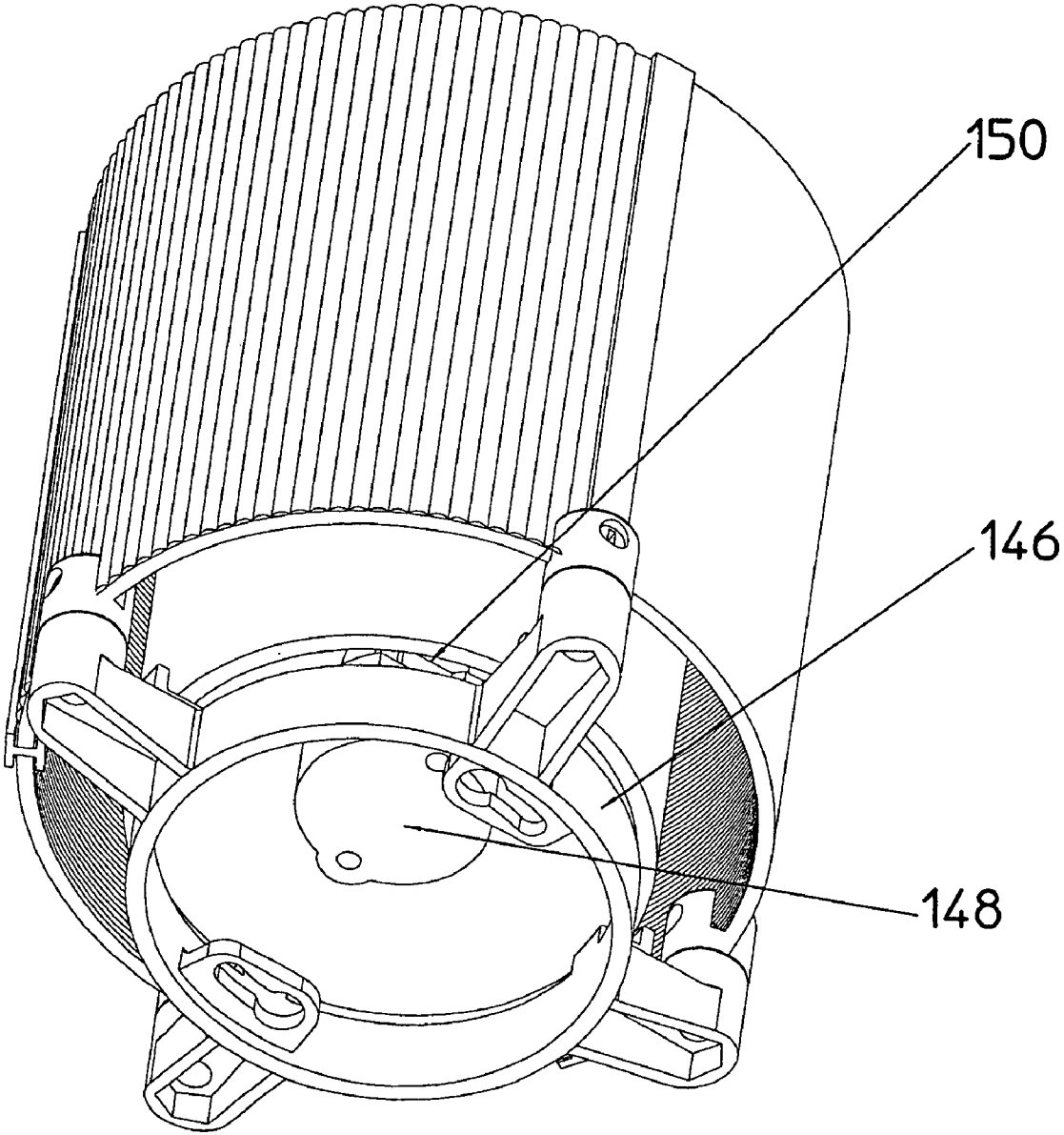
Figure 18:
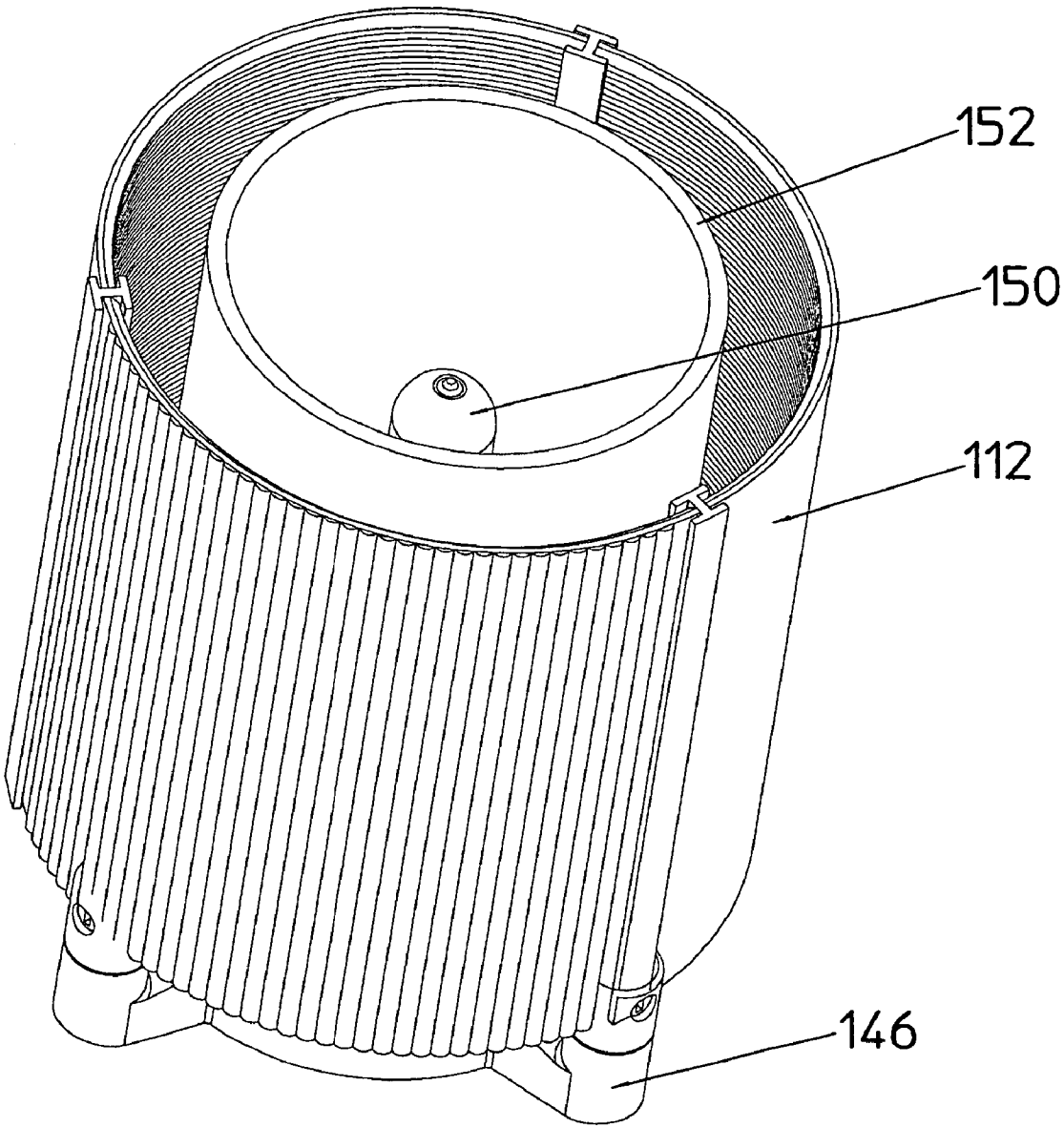

FIG. 12 shows a plane raw portion 124 in a perspective view. Prisms are an integral part on one side 126 of the raw portion. On the opposite side 128, cylindric lenses form an integral part. The prisms extend in a direction perpendicular to the axes of curvature of the cylindric lenses on the surface of the raw portion 124. Bending will produce a shield body 112 from this raw portion 124. A slightly bent raw portion 130 is shown in FIG. 13. The axis of curvature extends perpendicular to the tip edge 132 of the prisms and parallel with the envelope of the surface of the raw portion 134. In FIG. 14 the raw portion 134 is completely bent. The tip edges 136 of the original prisms form a 120° segment of a circle. FIGS. 15 to 18 illustrate how a shield body is assembled of the bent raw portion 134. For this purpose, a connection bar 140 with a H-shaped crossection is provided. The bar is shifted onto the edges of the raw portion 134. In the present embodiment, three raw portions 134, 142, and 144 are assembled by means of the bars 140 to form a shield body. This is shown in FIG. 16. On the outside, the raw portion 134 is provided with cylindric lenses with axes of curvature parallel to the axis of curvature of the raw portion. The raw portions 134, 142 and 144 assembled to a cylinder are set on a carrier 146 and fixed thereto by screwing or other means. The carrier 146 also serves for fixing the socket 148 of the lighting means 150. The lighting means is arranged in the center of the thus assembled shield body. This is shown in FIG. 17. FIG. 18 shows the assembly from a different perspective. The shield body 112 is made of plastic material, such as, for example, Polycarbonate or PMMA. In order to prevent the lighting means from transferring too much heat to the plastic material which could cause yellowing thereof or other heat damage thereto, a glass cylinder 152 is disposed between the shield body 112 and the lighting means 150, the glass cylinder 152 also being held by the carrier 146.

Figure 19:
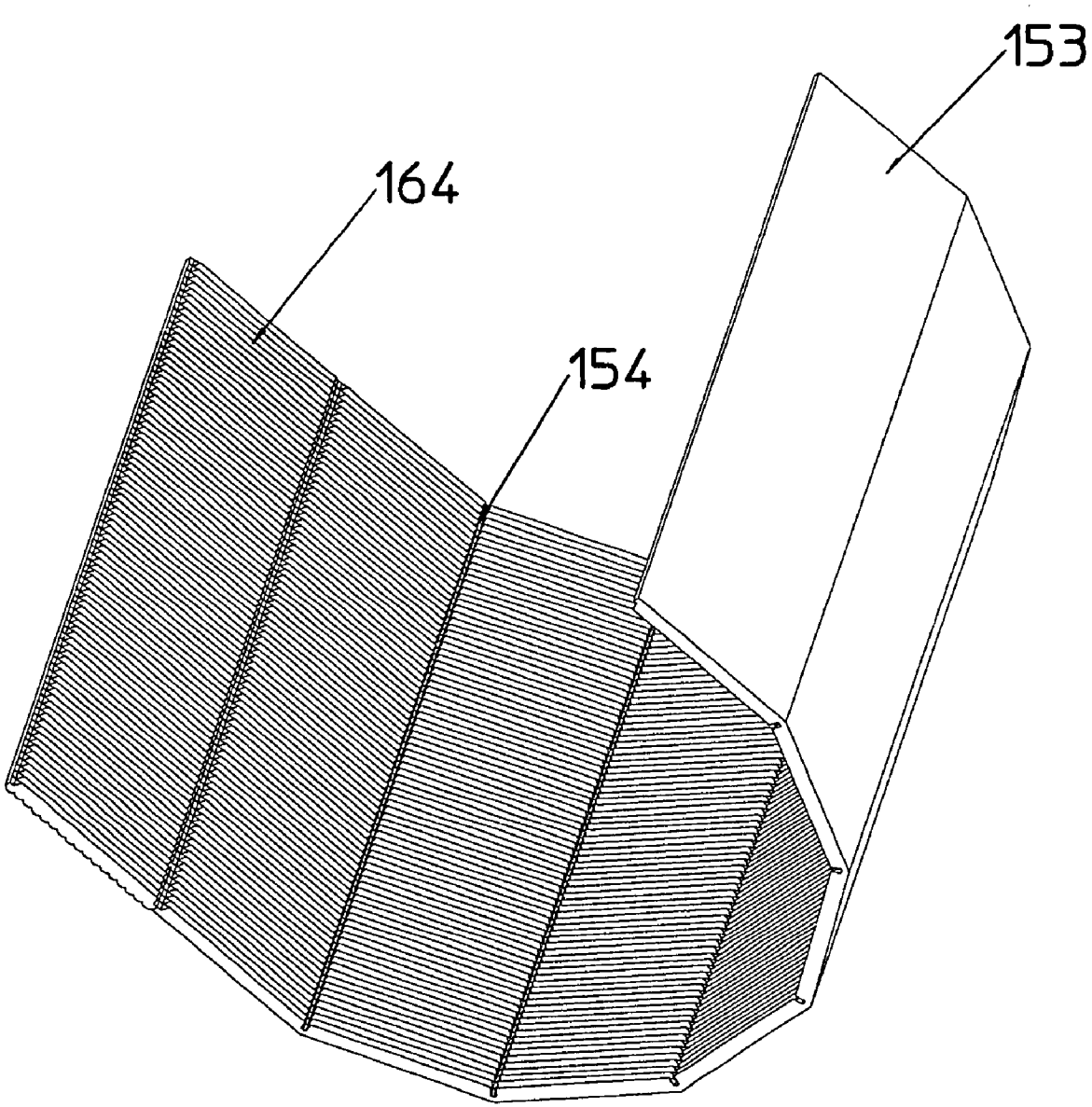
FIGS. 19 through 21 illustrate the manufacturing process for a shield body with a profile on the inside of a raw portion with predetermined bending lines.
Figure 20:
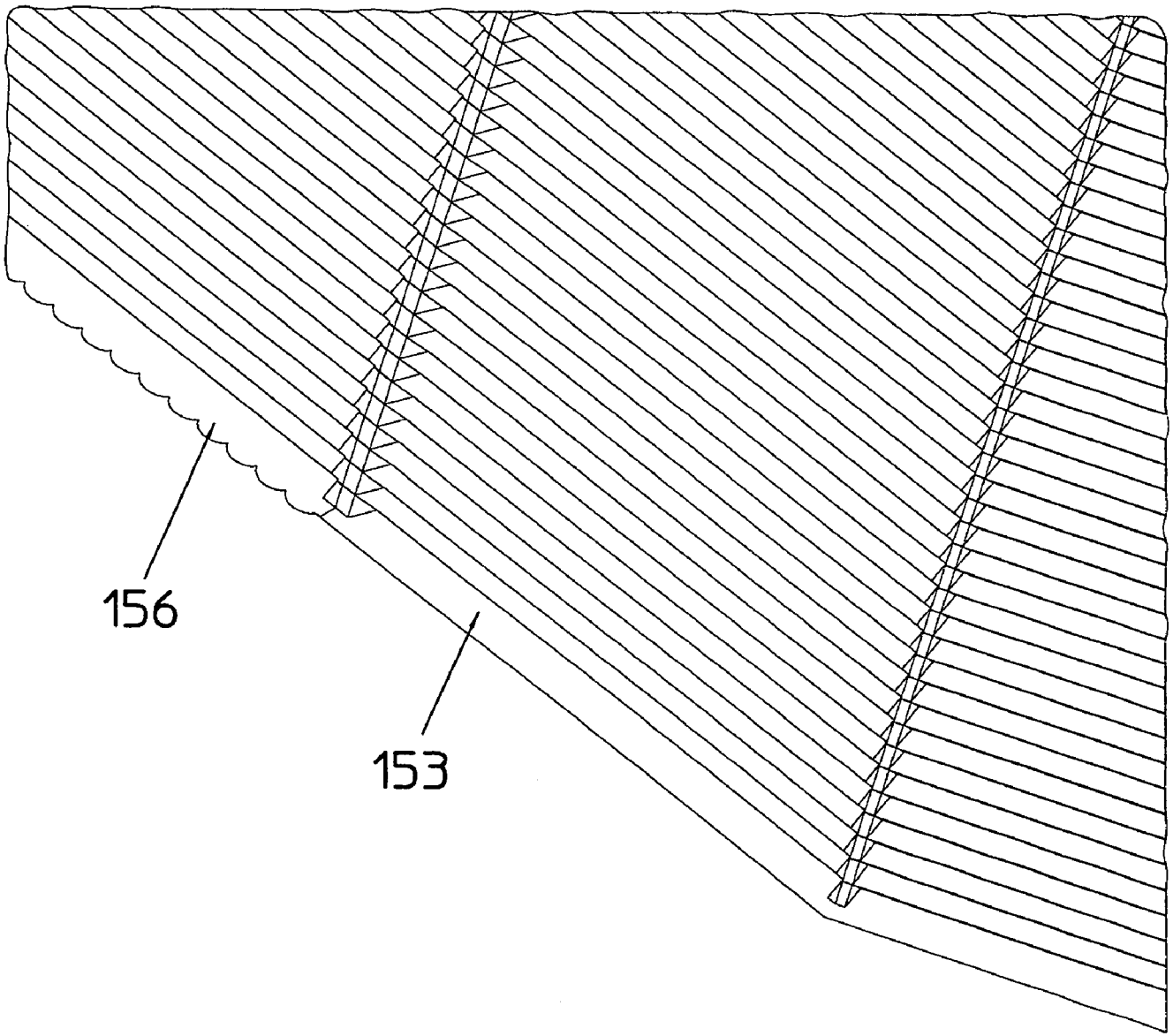
Figure 21:
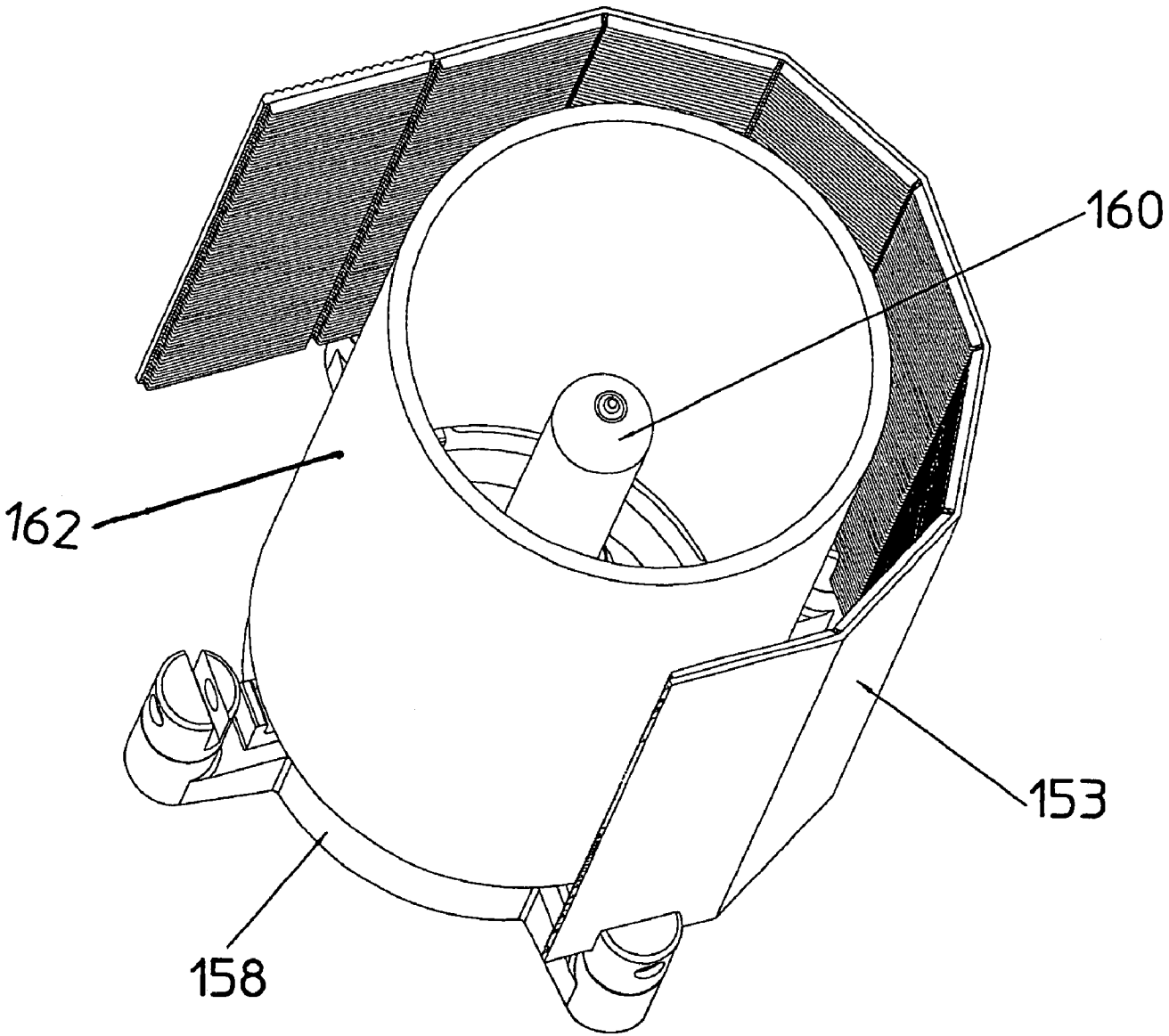

Instead of bending the raw portion described above in one piece, the raw portion with prism-shaped profiles may be folded in a facetted manner at predetermined folding lines from a plane plate to obtain a shield body. This is shown in FIGS. 19 to 21. A prismatic form with a smooth outer surface and, for example, twelve edges, is obtained (FIGS. 19 and 21 do not show the complete prismatic form with all of the facets and edges). The plane sides 153 of the raw portions may here be smooth from the outside or, as it is represented regarding the portion 156 in the section of FIG. 20, be provided with cylindric lenses. In this figure, the predetermined folding lines for bending under the influence of heat are clearly recognizable. Similarly to the shield assembly of the previous figures, the shield assembly 153 can be arranged around a lighting means 160 and a glass cylinder 162 on a carrier 158, as shown in FIG. 21. For purposes of this application, this configuration, although having a plurality of flat sides or facets, is considered as a cylindrical shield body.

The assemblies with prism-type profiles on the inside are particularly suitable for lighting means with large surfaces, such as ellipsoid lights, large surface sodium vapor lights, or fluorescent lights.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

The invention claimed is:

1. A device for shielding outside lights comprising:

mounting means for mounting a light source for emitting radiation;

a substantially cylindrical, transparent shield body;

said shield body having a surface which is provided with a zigzag-shaped profile in a vertical direction, said surface being adapted to deflect radiation incident thereon in a desired downward direction;

wherein said zigzag-shaped profile has a plurality of triangular projections in a first portion, said triangular projections in said first portion being configured in such a way that emitted radiation from a light source mounted in the mounting means is fully reflected in a desired direction when passing through said first portion of said shield body;

wherein said zigzag-shaped profile has a further plurality of triangular projections in a second portion, said further triangular projections in said second portion being configured in such a way that emitted radiation from a light source mounted in the mounting means is diffracted in a desired downward direction when passing through said second portion of said shield body;

wherein said triangular projections of said zigzag-shaped profiles in said first and second portions have straight sides; and wherein said zigzag-shaped profile is asymmetric regarding a horizontal plane defined by the center of a light source mounted in the mounting means.

2. Device according to claim 1, wherein said shield body is formed as an integral body.

3. Device according to claim 1, wherein said shield body has an inside and an outside and said zigzag-shaped profile is provided on said outside of said shield body.

4. Device according to claim 3, wherein said shield body has a conical shape on said inside.

5. Device according to claim 3, wherein cylindric lenses are provided on said inside of said shield body, said shield body defining an axial direction and said cylindric lenses having an axis of curvature extending in said axial direction of said shield body.

6. Device according to claim 1, wherein said shield body is made of glass.

7. Device according to claim 1, wherein said shield body has an inside and an outside and said zigzag-shaped profile is provided on said inside of said shield body.

8. Device according to claim 7, wherein said shield body is made of plastic.

9. Device according to claim 8, wherein said shield body defines an inner volume and a light transparent heat shield is provided in said inner volume of said shield body.

10. Device according to claim 9, wherein said heat shield is formed by a cylindrical glass body coaxially arranged within said shield body.

11. Device according to claim 10, wherein said shield body defines an axial direction and cylindric lenses are integrally provided inside on said heat shield, said cylindric lenses having an axis of curvature extending in said axial direction.

12. Device according to claim 8, wherein said plastic is selected from the group of plastics consisting of polymethyl methacrylate, polycarbonate, and combinations thereof.

13. Device according to claim 1, wherein said shield body defines a circumferential and an axial direction and wherein an auxiliary shield is provided outside said shield body for shielding selected angular regions in said circumferential direction.

14. Device according to claim 13, wherein said auxiliary shield comprises prisms having a prism ridge, said prism ridge extending in said axial direction and being positioned side-by-side in said circumferential direction.

15. Device according to claim 1, wherein said shield body defines a rotational axis and wherein said shield body is asymmetric with respect to said rotational axis.

16. Outside lighting comprising a lighting means and a device according to claim 1, wherein said device is coaxially positioned with said lighting means.

17. A device for shielding outside lights comprising:

a lighting means for emitting radiation;

a substantially cylindrical, transparent shield body;

said shield body having a surface which is provided with a zigzag-shaped profile in a vertical direction, said surface being adapted to deflect the radiation from the lighting means incident thereon in a desired downward direction;

wherein said zigzag-shaped profile has a plurality of triangular projections in a first portion, said triangular projections in said first portion being configured in such a way that said radiation from said lighting means is fully reflected in a desired direction when passing through said first portion of said shield body;

wherein said zigzag-shaped profile has a further plurality of triangular projections in a second portion, said further triangular projections in said second portion being configured in such a way that said radiation from said lighting means is diffracted in a desired direction when passing through said second portion of said shield body;

wherein said triangular projections of said zigzag-shaped profiles in said first and second portions have straight sides; and wherein said zigzag-shaped profile is asymmetric regarding a horizontal plane defined by the center of a light source mounted in the mounting means.

18. Method for producing an essentially cylindrical, transparent shield body with a surface which has a zigzag-shaped profile in an axial direction, the method comprising the steps of:

(a) pressing a transparent plastics material into a plane mould with zigzag-shaped surface, and thereby generating a plane form of plastics material;

(b) bending said form provided in step (a) in such a way, that a segment of said shield body is formed; and (c) attaching two or more segments together to form a full shield body.

19. A device for shielding outside lights comprising:

mounting means for mounting a light source for emitting radiation;

a substantially cylindrical, transparent shield body defining a circumferential and an axial direction;

said shield body having a surface which is provided with a zigzag-shaped profile in a vertical direction, said surface being adapted to deflect radiation incident thereon in a desired direction;

wherein said zigzag-shaped profile has a plurality of triangular projections in a first portion, said triangular projections in said first portion being configured in such a way that emitted radiation from a light source mounted in the mounting means is fully reflected in a desired direction when passing through said first portion of said shield body; and a desired direction when passing through said first portion of said shield body;

wherein said zigzag-shaped profile has a further plurality of triangular projections in a second portion, said further triangular projections in said second portion being configured in such a way that emitted radiation from a light source mounted in the mounting means is diffracted in a desired direction when Passing through said second portion of said shield body; and an auxiliary shield provided outside said shield body for shielding selected angular regions in said circumferential direction wherein said auxiliary shield comprises prisms having a prism ridge, said prism ridge extending in said axial direction and being positioned side-by-side in said circumferential direction.

* * * * *